US006539184B2

(12) United States Patent
Shimura et al.

(10) Patent No.: US 6,539,184 B2
(45) Date of Patent: Mar. 25, 2003

(54) IMAGE FORMING APPARATUS WITH CURRENT CONTROL

(75) Inventors: Masaru Shimura, Numazu (JP); Tomohiro Nakamori, Shizuoka-ken (JP); Hiroshi Takami, Odawara (JP); Hiroaki Sakai, Mishima (JP); Seiji Saito, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/835,324

(22) Filed: Apr. 17, 2001

(65) Prior Publication Data

US 2001/0055496 A1 Dec. 27, 2001

(30) Foreign Application Priority Data

Apr. 18, 2000 (JP) ..... 2000-116947

(51) Int. Cl.[7] ..... G03G 15/02
(52) U.S. Cl. ..... 399/50; 361/235
(58) Field of Search ..... 399/50, 168, 174, 399/176; 361/235

(56) References Cited

U.S. PATENT DOCUMENTS 4,028,596 A * 6/1977 Weber ..... 361/235
4,346,986 A * 8/1982 Kuge et al. ..... 399/50
5,420,671 A * 5/1995 Kisu et al. ..... 399/174
5,568,231 A * 10/1996 Asano et al. ..... 399/50 X

FOREIGN PATENT DOCUMENTS

| | | | |
|---|---|---|---|
| JP | 56-91254 | * | 7/1981 |
| JP | 59-101668 | * | 6/1984 |
| JP | 8-149808 | * | 6/1996 |
| JP | 10-3199 | * | 1/1998 |

OTHER PUBLICATIONS

U.S. patent application No. 09/842,620, filed Apr. 27, 2001.

* cited by examiner

*Primary Examiner*—Fred L Braun
(74) *Attorney, Agent, or Firm*—Fitzpatrick, Cella, Harper & Scinto

(57) ABSTRACT

An image forming apparatus includes an image bearing member and a charge member contacted to the image bearing member for electrically charging the image bearing member. An oscillating voltage including an AC voltage component is applied to the charge member. A first detector detects an AC current applied to the charge member and a second detector detects the AC current corresponding to a peak or a neighborhood of the peak of the AC voltage. A controller effects control such that current detected by the second detector is a predetermined level when the current detected by the first detector is within a predetermined range, and such that current detected by the first detector is a predetermined level when the current detected by the first detector is outside the predetermined range.

12 Claims, 9 Drawing Sheets

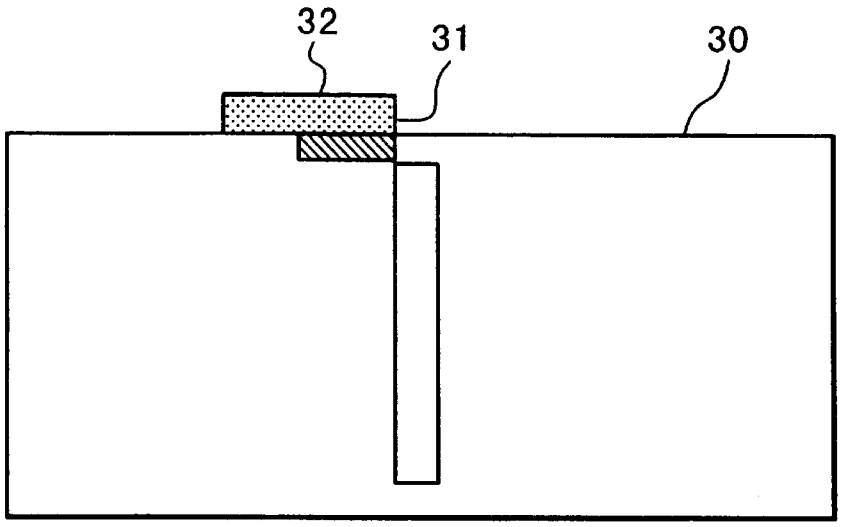
FIG. 16
| INTEGRATED CHARGING TIME(sec) | 0 | 30000 |
|---|---|---|
| LWR LIMIT AC CURRENT (μA) | 1300 | 1200 |
FIG. 17
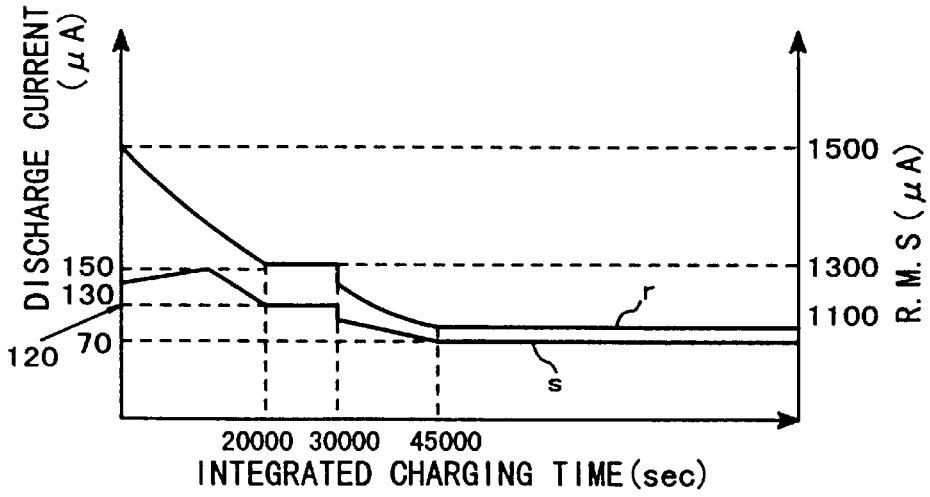
FIG. 18

IMAGE FORMING APPARATUS WITH CURRENT CONTROL

FIELD OF THE INVENTION AND RELATED ART

The present invention relates to an image forming apparatus, such as a copying machine, a printer, a facsimile, or the like, which employs an electrophotographic method to form an image. In particular, it relates to such an image forming apparatus that is provided with a charging member which charges an image bearing member by making contact with the image bearing member.

Conventionally, a corona based charging device has been used as a means for charging an image bearing member, such as an electrophotographic photosensitive member, an electrostatic recordable dielectric member, or the like, of an image forming apparatus, for example, a copying machine, a printer, and the like, which employs an electrophotographic, electrostatic, or the like recording method . When charging an image bearing member, a corona based charging device is placed close enough to the image bearing member to expose the peripheral surface of the image bearing member to the corona discharge from the corona based charging device so that the peripheral surface of the image bearing member is charged to the predetermined polarity and potential level.

In recent years, a contact type charging apparatus has been realized as a means for charging an image bearing member, because a contact type charging apparatus is advantageous over a corona based charging device in that a contact type charging apparatus produces a smaller amount of ozone, and consumes a smaller amount of electrical power, compared to a corona based charging device. When charging an image bearing member, a contact type charging apparatus, to which voltage is being applied, is placed in contact with the image bearing member, as an object to be charged, so that the peripheral surface of the image bearing member is charged to the predetermined polarity and potential level.

Among various contact type charging apparatuses, a roller based contact type charging apparatus, which employs an electrically conductive roller (hereinafter, "charge roller") as a charging member, is preferably employed from the standpoint of charge stability. When charging an image bearing member with the use of a roller based contact type charging apparatus, the charge roller as a charging member is directly pressed upon the image bearing member, while applying voltage to the charge roller, so that the image bearing member is charged.

Referring to FIG. 19, a charge roller 101, that is, the charging member of a conventional contact type charging apparatus, is kept directly pressed upon the peripheral surface of an electrophotographic photosensitive member 100 (hereinafter, "photosensitive drum") in the form of a rotational drum, as an image bearing member, maintaining a predetermined amount of contact pressure between the charge roller 101 and photosensitive drum 100. As a predetermined voltage is applied to the charge roller 101 from a charge bias power source 102, the peripheral surface of the photosensitive drum 100 is charged to a predetermined potential level. Generally, the charge roller 101 is rotated by the rotation of the photosensitive drum 100 as the photosensitive drum 100 is rotationally driven.

When the photosensitive drum 100 is charged by the charge roller 101 placed in contact with the photosensitive drum 100, the photosensitive drum 100 is charged by electrical discharge. Therefore, the photosensitive drum 100 begins to be charged as a voltage, the potential level of which is higher than a certain level, or the threshold level, is applied to the charge roller 101 from the charge bias power source 102. For example, in order to charge the photosensitive drum 100 having a 25 $\mu$m thick photosensitive layer of OPC by directly pressing the charge roller 101 upon the photosensitive drum 100, a voltage of approximately 600 V must be applied to the charge roller 101. In other words, as the potential level of the voltage applied to the charge roller 101 is increased to approximately 600 V, the surface potential level of the photosensitive drum 100 begins to rise, and then, as the potential level of the voltage applied to the charge roller 101 is further increased, the surface potential level of the photosensitive drum 100 linearly increases in proportion to the increase in the level of the applied voltage.

Hereinafter, this threshold voltage value, that is, the value of the DC voltage at which an object to be charged (photosensitive drum) begins to be charged as the value of the DC voltage being applied to the charging member (charge roller) is increased, will be referred to as the "charge (discharge) start voltage value Vth" of the object.

There are different contact type charging methods: "DC based charging method" and "AC based charging method", which will be described below. In a DC based charging method, only DC voltage is applied to a charging member to charge an object, whereas in an AC based charging method, such AC voltage (oscillating voltage: voltage, the value of which periodically changes with the elapsing of time) that has an AC component and a DC component is applied to a charging member to charge an object.

(1) DC Based Charging Method

When charging an object to be charged (photosensitive drum) to a predetermined surface potential level Vd using a DC based charging method, a DC voltage, the potential level of which is equal to the total of the potential level Vd and the charge start voltage value Vth of the object to be charged (photosensitive drum), is applied to a charging member. A DC based charging method is not satisfactory in terms of charge uniformity. Further, it lacks convergency regarding the potential level higher than Vd. Therefore, an object to be charged (photosensitive drum) needs to be pre-exposed.

(2) AC Based Charging Method

An AC based charging method is superior to a DC based charging method in terms of charge uniformity. When charging an object to a predetermined surface potential level of Vd using an AC based charging method, an oscillating voltage created by combining an offset DC voltage, the potential level of which is equivalent to a predetermined surface potential level to which the object is to be charged, with an AC voltage, the peak-to-peak voltage of which is no less than 2×Vth, is applied to a charge roller.

This charging method is employed to take advantage of the leveling effect of the AC component represented by the line a in FIG. 20, so that the surface potential level of the photosensitive drum, as an object to be charged, converges to the middle of the top and bottom peak voltage levels of the AC component, as represented by the line b in FIG. 20, according to the gaps between the charging member (charge roller) and the photosensitive drum.

In an image forming apparatus, the charging apparatus for charging the image bearing member (photosensitive drum) uniformly charges the peripheral surface of the image bearing member to a predetermined potential level to form an electrostatic latent image on the peripheral surface of the image bearing member. After the formation of the electrostatic latent image, the charging apparatus removes the electrical charge on the peripheral surface of the image bearing member in order to erase the potential level history on the image bearing member.

In other words, in an AC based charging method, when charging an image bearing member, the surface potential level of the image bearing member can be made to converge to the predetermined level of Vd uniformly across the entirety of the peripheral surface of the image bearing member by using a DC voltage, as an offset voltage, the potential level of which equals the potential level of the dark area (unexposed portion of charged peripheral surface of image bearing member), whereas when discharging the peripheral surface of the image bearing member, the surface potential level of the image bearing member can be made to converge to 0 V uniformly across the entirety of the peripheral surface of the image bearing member, by using 0 V as the offset voltage. Therefore, an AC based charging method is advantageous over a DC based charging method, a corona based charging device, and the like.

However, in an AC based charging method, leakage or improper charging occurs sometimes since the impedance of a charge roller as a charging member fluctuates due to changes in the charge roller ambience. Thus, it has been a common practice to automatically compensate for the change in the charge roller performance resulting from the changes in the ambience of the charge roller; control was executed so that the current value of the AC voltage applied to the charging roller remained constant. As a commonly used control for keeping constant the amount of electrical current, there are method in which current is kept constant in terms of its peak value, r.m.s. value, and the like.

The aforementioned conventional AC based contact type charging method, however, had the following problems.

In an AC based charging method, positive and negative voltages are alternately applied to a charging member, reversing the direction in which electrical discharge occurs. As a result, the peripheral surface of the photosensitive drum as an object to be charged is substantially deteriorated by this repetitive electrical discharge, and the deteriorated portions of the peripheral surface of the photosensitive drum are shaved away due to the friction caused by such a member as a cleaning blade as a cleaning member which comes into contact with the peripheral surface of the photosensitive drum (photosensitive drum shaving). Therefore, the photosensitive layer of the photosensitive drum becomes gradually thinner, and eventually, it becomes too thin to be effective as a photosensitive layer. For example, it becomes nonuniformly charged in microscopic terms, and/or its charge retaining performance declines. In other words, it fails to be properly charged.

Thus, the length of the service life of an image forming apparatus, or the length of a process cartridge comprising at least a photosensitive drum and a charging member (charge roller), is determined by the number of prints (image formation count) which can be produced before the thickness of the photosensitive layer of the photosensitive drum reduces to its limit.

In recent years, due to environmental problems, increase in printer load (image forming apparatus load) resulting from computer networking, and the like causes, demand for a more durable process cartridge has been increasing; in other words, it has become necessary to increase the length of the service life of a photosensitive drum. As a method for lengthening the service life of an electrophotographic image forming apparatus, there are a few that can be considered, for example, a method in which the initial thickness of the photosensitive layer of a photosensitive drum is increased, and a method in which the amount of the deterioration of a photosensitive drum is reduced by reducing the amount of the electrical discharge from the charge roller as a charging member.

However, simply increasing the thickness of the photosensitive layer of a photosensitive drum degrades the ability of the photosensitive member in terms of surface charge retention, resulting sometimes in a blurred electrostatic image. It has been known that if the amount of the electrical discharge is excessively reduced, the electrical discharge tends to become unstable, and also that if the electrical discharge becomes unstable, the peripheral surface of the photosensitive drum is improperly charged, for example, nonuniformly charged, which results in an unsatisfactory image.

As a method for controlling the AC voltage applied to a charge roller, the aforementioned constant current control is widely used. However, in the constant current control, discharge current (current applied to contact type charging member from power source) which affects the length of the service life of a photosensitive drum is not directly controlled, although the amount of the current which flows to the photosensitive drum from the contact type charging member such as a charge roller is kept constant.

For example, when the amount of the discharge current is kept at an approximate value at which improper charging does not occur in the initial period of the charge roller usage, it is impossible for the efficiency with which a photosensitive drum is charged by a charger roller to be maintained, throughout the entire service life of the photosensitive drum, at the same level as that when both components are brand-new. This is because the manner in which a photosensitive drum is charged changes due to the contamination of a charge roller by toner, and the decrease in the thickness of the photosensitive layer of the photosensitive drum. Thus, in the conventional constant current control in which the AC current level is set so that a photosensitive drum is properly charged in the initial stage, the amount of electrical discharge increases compared to that in the initial stage, increasing thereby the amount of the photosensitive drum shaving as the usage of the photosensitive drum accumulates, in other words, shortening the service life of the photosensitive drum.

SUMMARY OF THE INVENTION

The primary object of the present invention is to provide an image forming apparatus capable of preventing its image bearing member from being deteriorated by discharge current while preventing the improper charging of the image bearing member.

Another object of the present invention is to provide an image forming apparatus comprising: an image bearing member; a charging member for charging said image bearing member by making contact with said image bearing member; a voltage applying means for applying oscillating voltage comprising AC voltage to said charging member; a first detecting means for detecting the value of the AC current applied to said charging member; a second detecting means for detecting the value of the said AC current when said AC voltage is at or near its peak; and a controlling means which controls said voltage applying means in such a manner that when the current value detected by said first detecting means is within a predetermined range, the current value detected by said second detecting means remains at a predetermined value, whereas when the current value detected by said first detecting means is outside said predetermined range, the current value detected by said first detecting means remains at a predetermined value.

These and other objects, features, and advantages of the present invention will become more apparent upon consideration of the following description of the preferred embodiments of the present invention, taken in conjunction with the accompanying drawings.

BRIEF DESCRIPTION OF THE DRAWINGS

FIG. 16 is a drawing of a nonvolatile storage medium mounted in the process cartridge.

FIG. 17 is a table for showing the relationship between the cumulative length of charging time and bottom limit of the AC current.

FIG. 18 is a graph for showing the relationship among the cumulative length of charging time, r.m.s. value of the AC current applied to the charge roller, and amount of the discharge current.

DESCRIPTION OF THE PREFERRED EMBODIMENTS

Hereinafter, the preferred embodiments of the present invention will be described with reference to the appended drawings.

EMBODIMENT 1

Figure 1:
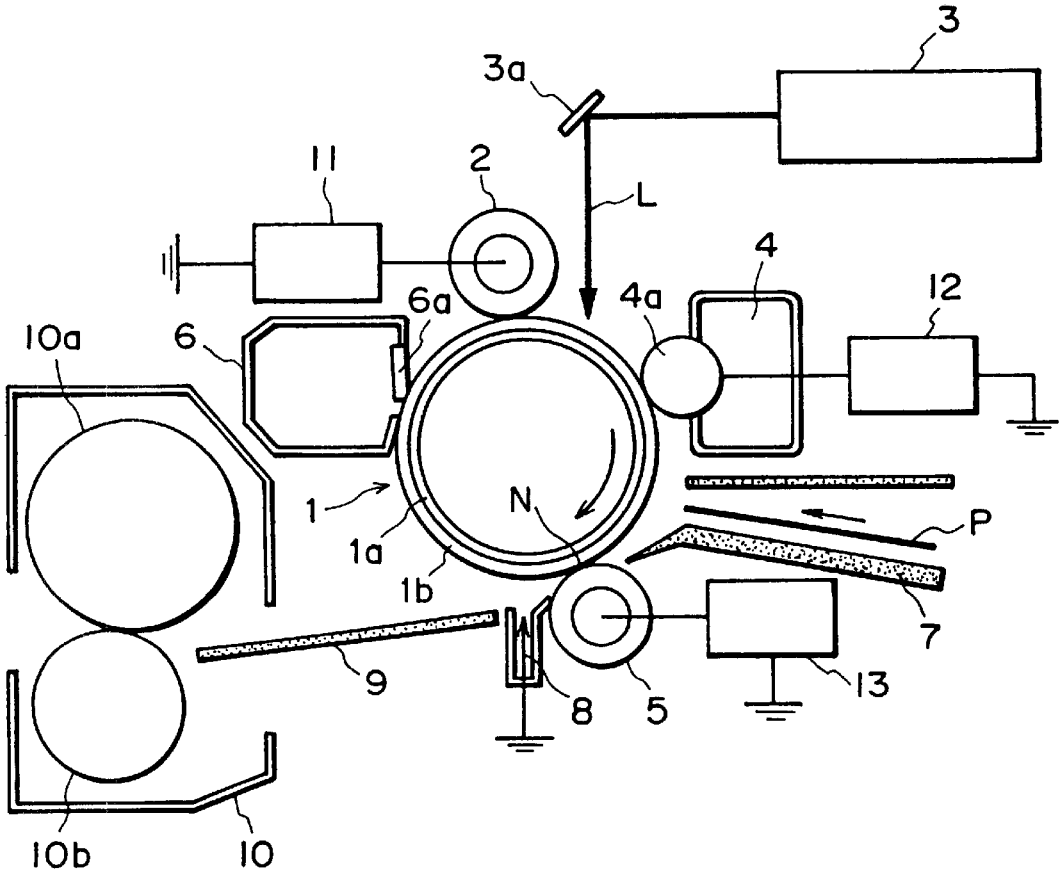
FIG. 1 is a sectional view of the image forming apparatus in an embodiment of the present invention.

FIG. 1 is a drawing for showing the general structure of the image forming apparatus in the first embodiment of the present invention. The image forming apparatus in this embodiment is an electrophotographic laser beam printer.

This image forming apparatus is provided with a photosensitive drum 1 as an image bearing member. Placed in a manner to surround the photosensitive drum 1 are a charge roller 2, a developing apparatus 4, a transfer roller 5, and a cleaning apparatus 6. Diagonally above the photosensitive drum 1, an exposing apparatus 3 is positioned so that the point at which the photosensitive drum 1 is exposed falls between the point at which the photosensitive drum is charged and the point at which the photosensitive drum is developed. Further, on the upstream side of the transfer nip N between the photosensitive drum 1 and transfer roller 5, in terms of the transfer medium conveyance direction, a transfer guide 7 is placed, and on the downstream side of the transfer nip N in terms of the transfer medium conveyance direction, a discharge needle 8, a conveyance guide 9, and a fixing apparatus 10 are placed.

In this embodiment, the photosensitive drum 1 is an organic photosensitive member which is charged to negative polarity. It comprises an aluminum drum 1*a*, or a base member, and a photosensitive layer 1*b*. It is rotationally driven at a predetermined peripheral velocity in the direction (clockwise direction) indicated by an arrow mark. As it is rotationally driven, it is uniformly charged to the negative polarity by the charge roller 2 placed in contact therewith.

The charge roller 2 as a contact type charging means is rotational, and is placed in contact with the peripheral surface of the photosensitive drum 1, being thereby rotated by the photosensitive drum 1, and as charge bias (which will be described later) is applied to the charge roller 2 from a charge bias power source 11, the charge roller 2 uniformly charges the peripheral surface of the photosensitive drum 1 to predetermined polarity and potential level.

The exposing apparatus 3 comprises an unshown laser driver, a laser diode, a polygon mirror, and the like. In operation, a beam of laser light L modulated with sequential electrical digital signals in accordance with image formation data inputted to the laser driver from a personal computer (unshown) or the like, is outputted from the laser diode, is reflected by the polygon mirror, which is being rotated at a high speed, in a manner to scan the peripheral surface of the photosensitive drum 1, by way of the reflection mirror 3*a*. As a result, an electrostatic latent image which reflects the image formation data is formed on the peripheral surface of the photosensitive drum 1.

The developing apparatus 4 is provided with a development sleeve 4*a*, which is rotatable, and is positioned in such a manner that the peripheral surfaces of the development sleeve 4*a* and photosensitive drum 1 virtually contact each other in the development station. In operation, toner is adhered to an electrostatic latent image on the peripheral surface of the photosensitive drum 1 by the development sleeve 4*a* to which development bias is being applied from a development bias power source 12, in the development station. As a result, the electrostatic latent image is developed into a toner image, or a visible image.

The transfer roller 5 is kept pressed upon the peripheral surface of the photosensitive drum 1 with the application of a predetermined pressure, forming a transfer nip N. In operation, as transfer bias is applied to the transfer roller 5 from a transfer bias power source 13, the toner image on the photosensitive drum 1 is transferred onto a transfer medium P, or a recording medium, in the transfer nip N between the photosensitive drum 1 and transfer roller 5.

The cleaning apparatus 6 has a cleaning blade 6*a*, and removes, with the cleaning blade 6*a*, the transfer residual toner, that is, the toner remaining on the peripheral surface of the photosensitive drum 1 after the transfer.

The fixing apparatus 10 has a fixing roller 10*a* and a pressing roller 10*b*, which are rotational. In operation, the fixing apparatus 10 thermally fixes the toner image on the transfer medium P to the transfer medium P with the application of heat and pressure, while the transfer medium P is conveyed through the fixing nip between the fixing roller 10*a* and pressing roller 10*b*, being pinched by the two rollers.

Next, the image forming operation by the above described image forming apparatus will be described.

In an image forming operation, the photosensitive drum 1 is rotationally driven at a predetermined peripheral velocity in the direction indicated by an arrow mark, and as the photosensitive drum is rotationally driven, the peripheral surface of the photosensitive drum 1 is uniformly charged by the charge roller 2 to which charge bias is being applied.

The uniformly charged portion of the peripheral surface of the photosensitive drum is exposed to the image exposing light L projected from the exposing apparatus 3. As a result, an electrostatic latent image which reflects the image formation data inputted from a personal computer (unshown) or the like is formed.

To the electrostatic latent image on the photosensitive drum 1, toner, which has been charged to the same polarity as the polarity (negative polarity) to which the peripheral surface of the photosensitive drum 1 has been charged, is adhered in the development station by the development sleeve 4*a* of the developing apparatus 4, to which the development bias, the polarity of which is the same as the polarity to which the peripheral surface of the photosensitive drum 1 has been charged. As a result, the electrostatic latent image is developed into a toner image, or a visible image.

Meanwhile, the transfer medium P such as a sheet of paper is conveyed, being guided by the transfer guide 7, and arrives in the transfer nip N between the photosensitive drum 1 and transfer roller 5, in synchronism with the arrival of the toner image on the photosensitive drum 1 in the transfer nip N.

In the transfer nip N, transfer bias, the polarity (positive) of which is opposite to that of the toner, is applied to the transfer roller 5. As a result, electrostatic force is induced between the photosensitive drum 1 and transfer roller 5, and the toner image on the photosensitive drum 1 is transferred onto the transfer medium P by this electrostatic force. After the transfer of the toner image, the transfer medium P is discharged by the discharge needle 8. Then, the transfer medium P is conveyed, being guided by the conveyance guide 9, to the fixing apparatus 10. In the fixing apparatus, the toner image is fixed to the transfer medium P in the fixing nip N between the fixing roller 10*a* and pressing roller 10*b*, with the application of heat and pressure. Lastly, the transfer medium P is discharged from the image forming apparatus, ending one cycle of the image formation sequence.

As for the transfer residual toner remaining an the peripheral surface of the photosensitive drum 1 after the transfer of the toner image, it is removed by the cleaning blade 6*a* of the cleaning apparatus 6, and is recovered.

Next, the charge bias applied to the charge roller 2 from the charge bias power source 11 will be described.

Figure 2:
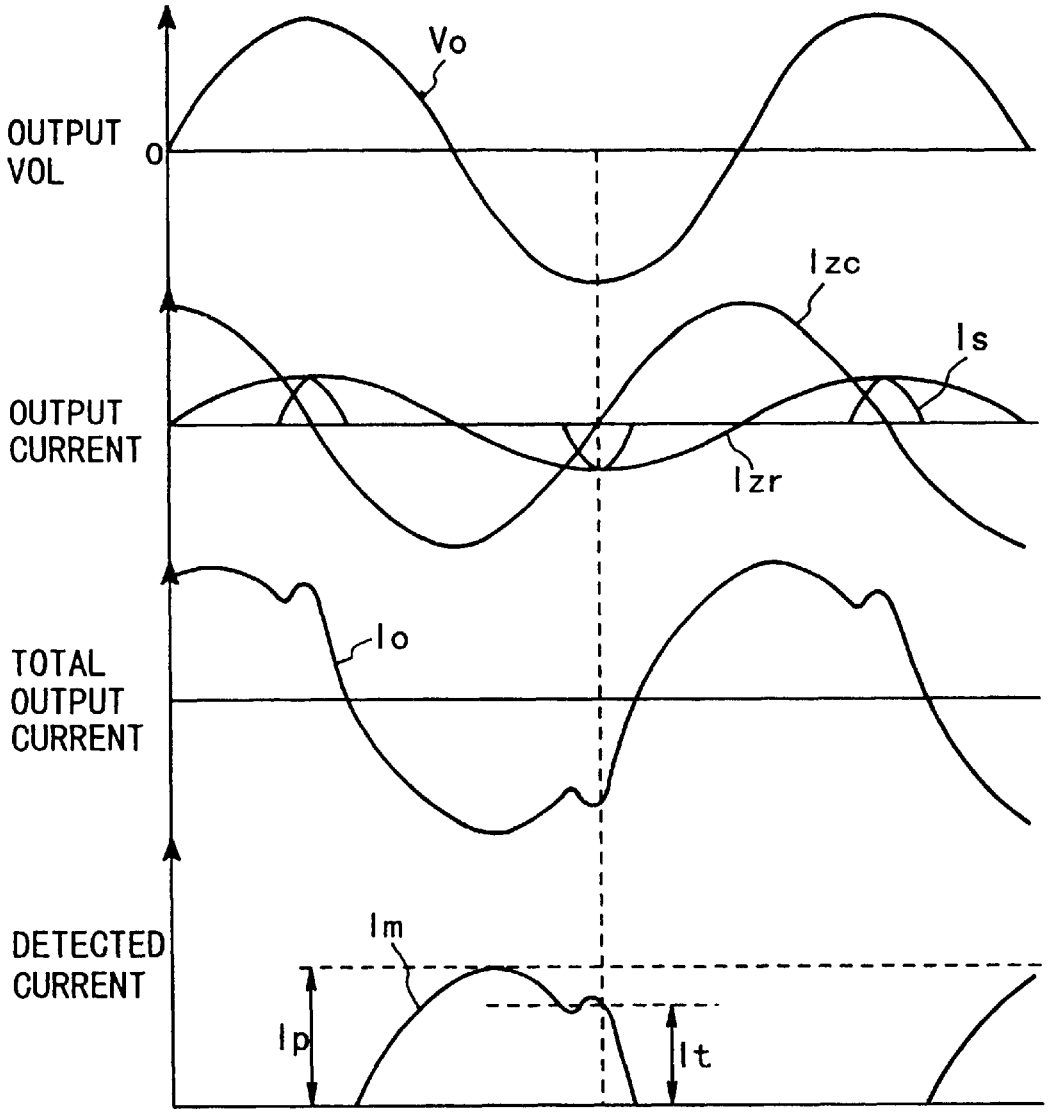
FIG. 2 is a graph for showing the wave-forms of the AC current applied to the charge roller.

From the charge bias power source 11 to the charge roller 2, output voltage (AC voltage Vo having a sinusoidal wave-form) and total output current (Io), which have wave-forms shown in FIG. 2, are applied. In other words, as the high AC voltage having the sinusoidal wave-form (Vo) is applied to the charge roller 2, a current having the same phase as that of this AC voltage, that is, the load current (Izr) which flows to the resistive load between the charge roller 2 and photosensitive drum 1, a current, the phase of which is 90 degrees advanced, that is, the load current (Izc) which flows to the capacitive load between the charge roller 2 and photosensitive drum 1, and a pulsating current which flows when the AC voltage (Vo) is at its peak amplitude, that is, the discharge current (Is) between the charge roller 2 and photosensitive drum 1, flow in combination, compounding into the total output current (Io) having the wave-form designated by a referential code Io in FIG. 2.

Figure 3:
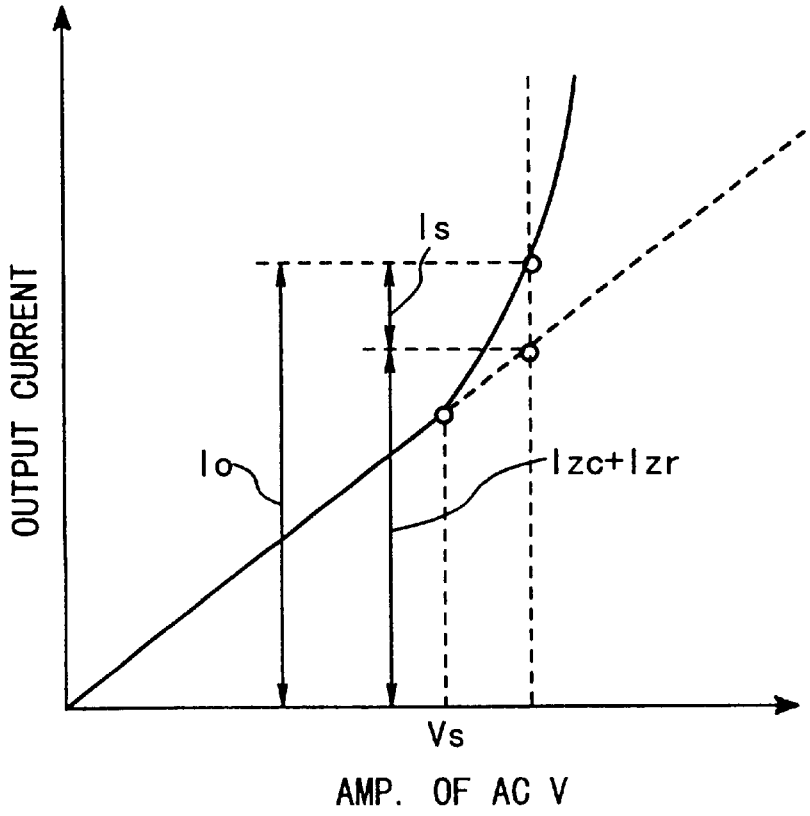
FIG. 3 is a graph for showing the relationship between the AC voltage and AC current applied to the charge roller.

The detected current (Im) is such an AC current that is drawn into the charge bias power source 11 from the charge roller 2, and has the wave-form designated by a referential code Im in FIG. 2. FIG. 3 is a graph for showing the relationship between the amplitude of the output voltage (AC voltage) and output current (amount of output current). As is evident from FIG. 3, when the amplitude of the output voltage is gradually increased, the amount of the output current is approximately proportional to the amplitude of the output voltage, while the amplitude of the output voltage is no greater than the level at which electrical discharge begins.

This is because the amounts of the resistance loaded current (Izr) and capacity loaded current (Izc) are proportional to the amplitude of the output voltage, and electrical discharge does not occur due to the small voltage amplitude, in other words, discharge current (Is) does not flow. As the output voltage amplitude is further increased, electrical discharge begins at a certain level (Vs), and the proportional relationship between the total output current (Io) and the output voltage amplitude is disrupted, in other words, the amount of the total output current (Io) increases by the amount equal to the amount of the discharge current (Is).

Figure 4:
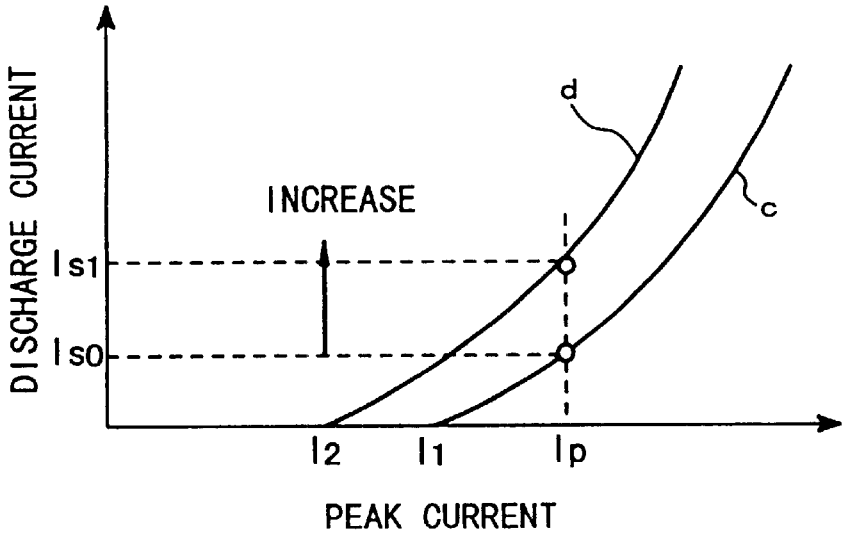
FIG. 4 is a graph for showing the relationship between the amount of the peak current applied to the charge roller and the amount of the discharge current.

In the above described conventional constant current control, the amount of the discharge current (Is) is controlled by keeping the peak value (Ip of detected current in FIG. 2) of the total output current at a predetermined value. Referring to FIG. 4, during the initial period of the charge roller 2 usage in which the charge roller 2 has a characteristics c, the electrical discharge start current value is I1. However, as the usage of the charge roller 2 continues, the characteristic of the charge roller 2 changes due to the contamination of the charge roller 2 by the toner and the like. Thus, while the characteristic of the charge roller 2 changes to a characteristic d, the electrical discharge start current value drops to a value I2 from the value I1. Meanwhile, the amount of the discharge current corresponding to the peak current value Ip increases from Is0 to Is1.

Figure 5:
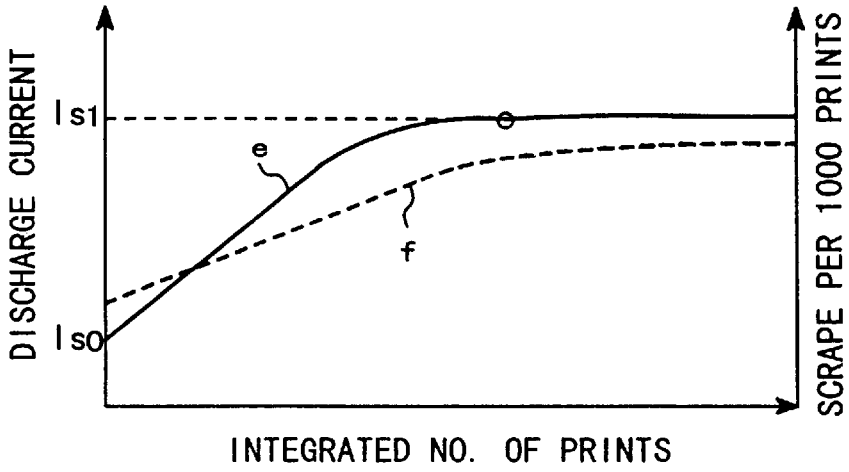
FIG. 5 is a graph for showing the relationship among the cumulative print count, amount of the discharge current, and amount of drum shaving.

Therefore, if the amount of the peak current is kept constant, the amount of the discharge current e increases from Iso, or the initial value, to Is1 as the cumulative print count (image formation count) increases, as shown in FIG. 5.

On the other hand, an amount f (per 1,000 prints) of the shaving of the photosensitive layer 1*b*, or the surface layer, of the photosensitive drum 1, which deteriorates the photosensitive drum 1, increases in proportion to the amount of the discharge current. Therefore, in the case of the conventional control method, the speed at which the photosensitive layer 1*b*, or the surface layer, of the photosensitive drum 1 is shaved accelerated, shortening the service life of the photosensitive drum 1 at an accelerated rate, as the cumulative print count increases.

Thus, in this embodiment, control is executed in such a manner that when the value Ip of the peak current applied to the charge roller 2 is within a preset range, the amount of the instantaneous current correspondent to the moment when the AC voltage is at or near the positive or negative peak, in other words, the amount of the AC current correspondent to the peak or its adjacencies of the AC voltage (value It of detection current in FIG. 2), remains at a predetermined level (within a predetermined range), whereas when the peak current value Ip is outside the preset range, the amount of the peak current value Ip remains at the predetermined level.

Figure 6:
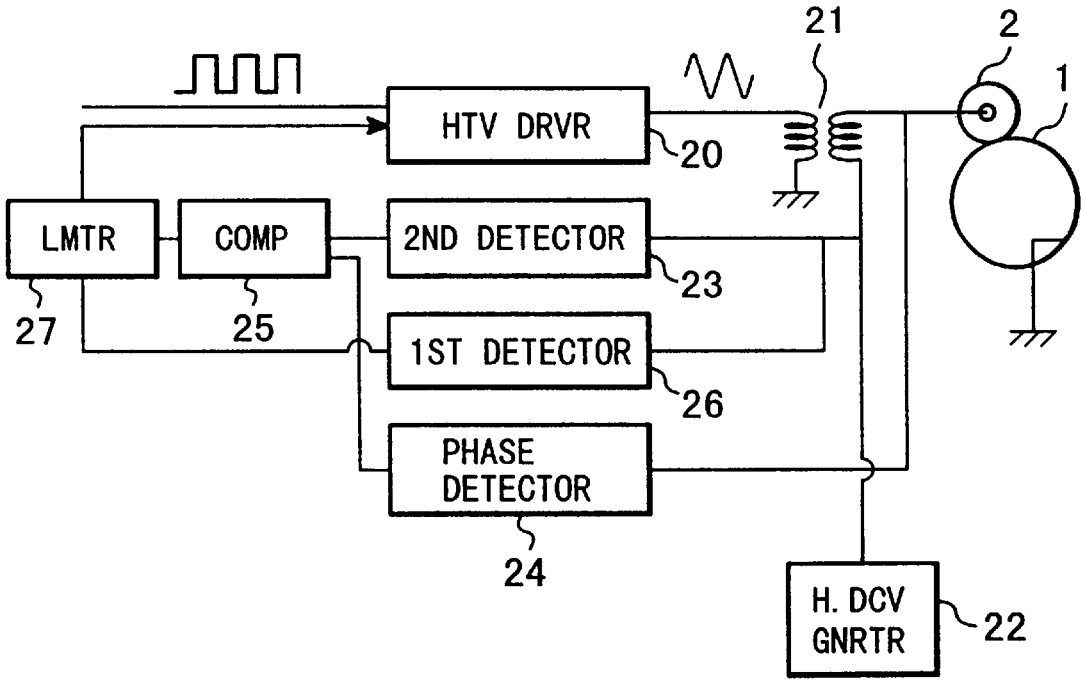
FIG. 6 is a block diagram of the control system for controlling the charge bias applied to the charge roller.

More specifically, referring to FIG. 6, the clock pulses from the printer control (unshown) are received by a high voltage transformer driving circuit 20, from which AC voltage having a sinusoidal waveform is outputted. The AC component of this AC voltage is amplified by the high voltage transformer 21. The thus obtained AC voltage and the DC voltage from a DC voltage generation circuit are applied in combination to the charge roller 2. A combination of the high voltage transformer driver, high voltage transformer 21, and DC voltage generation circuit 21 in FIG. 6 is equivalent to the charge bias power source 11 in FIG. 1.

The amount (detection current It in FIG. 2) of the instantaneous current correspondent to the positive or negative peak, or the adjacencies thereof, of the aforementioned AC voltage is detected by inputting the current (second AC current), which is applied from the high voltage transformer 21 and is detected by the second current detecting means 23, and the phase data detected by a phase detection circuit 24, into a comparator 25.

Further, the peak value of the total output current Io (first AC current) applied to the charge roller 2 is detected by the first current detecting means 26, and whether or not the value of the peak current Ip actually detected by the first current detecting means 26 is within the predetermined range is determined by a limiter circuit 27. When the peak current Ip actually detected by the first current detecting means 26 is within the predetermined range, AC voltage is applied to the charge roller 2 while executing such a control that the amount of the instantaneous current, which is correspondent to the positive or negative peak of the AC voltage and is detected by the second current detecting means 23, remains at a predetermined level.

On the other hand, when the value of the peak current Ip actually detected by the first current detecting means 26 is outside the predetermined range, the AC voltage is applied to the charge roller 2 while executing such a control that the peak current Ip remains at the predetermined level.

Figure 7:
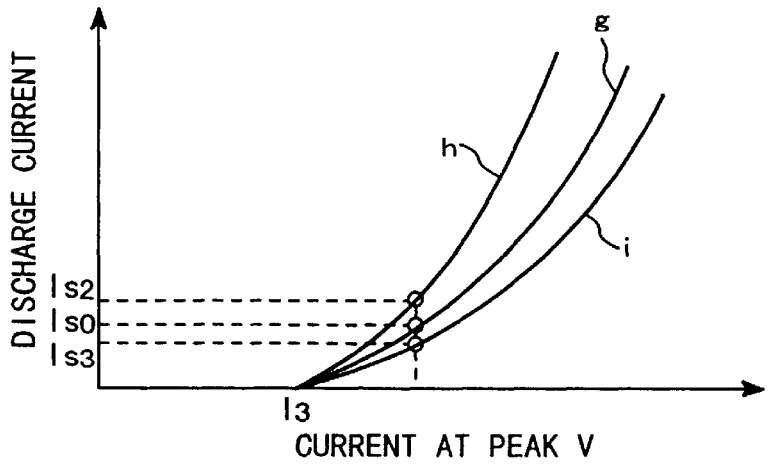
FIG. 7 is a graph for showing the relationship between the amount of the current and the amount of the discharge current, when the AC voltage applied to the charge roller is at its peak.

When such control that keeps the amount of the instantaneous current correspondent to the positive or negative peak of the AC voltage, at the predetermined level is executed, the relationship between the amount of the instantaneous current correspondent to the positive or negative peak of the AC voltage and the amount of the discharge current, displays such characteristics that are represented by the curved lines in FIG. 7 (curved line g represents the initial period of usage, whereas curved lines h and i represent the period after a substantial amount of usage). Incidentally, a referential code I3 in FIG. 7 represents the discharge start current value.

Figure 8:
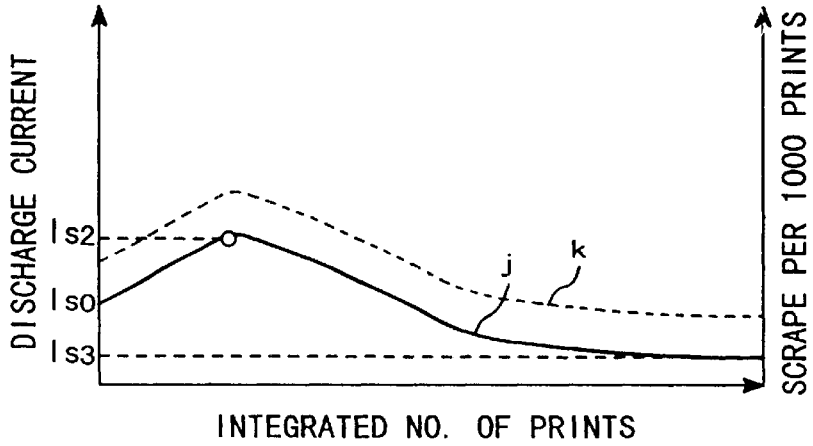
FIG. 8 is a graph for showing the relationship among the cumulative print count, amount of the discharge current, and amount of drum shaving.

Referring to FIG. 8, the amount j of the discharge current becomes Is2, showing a slight increase compared to the amount Iso of the discharge current during the initial period of usage, and then, slightly reduces to Is3. This is due to the fact that the phase of the total output current (Io) shifts relative to that of the AC voltage, because the resistance of the charge roller 2 changes as the charge roller 2 is contaminated by toner or the like, and/or the thickness of the photosensitive layer 1*b* of the photosensitive drum 1 decreases, which changes the resistance and electrostatic capacity of the photosensitive drum 1. The discharge current levels Iso, Is2, and Is3 in FIG. 7 are the same as the discharge current levels Iso, Is2, and Is3 in FIG. 8. The characteristic curve k in FIG. 8 represents the amount of the photosensitive drum shaving per 1,000 prints (1k) correspondent to the discharge current amount j.

Figure 9:
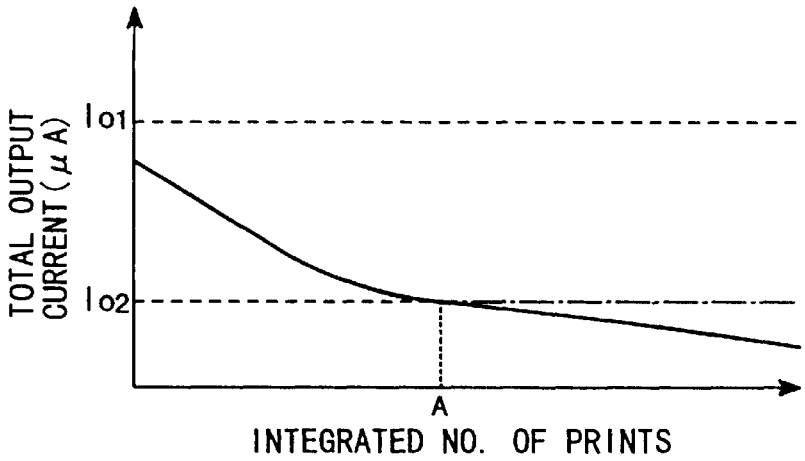
FIG. 9 is a graph for showing the relationship between the cumulative print count and the total output current of the AC current applied to the charge roller.
Figure 10:
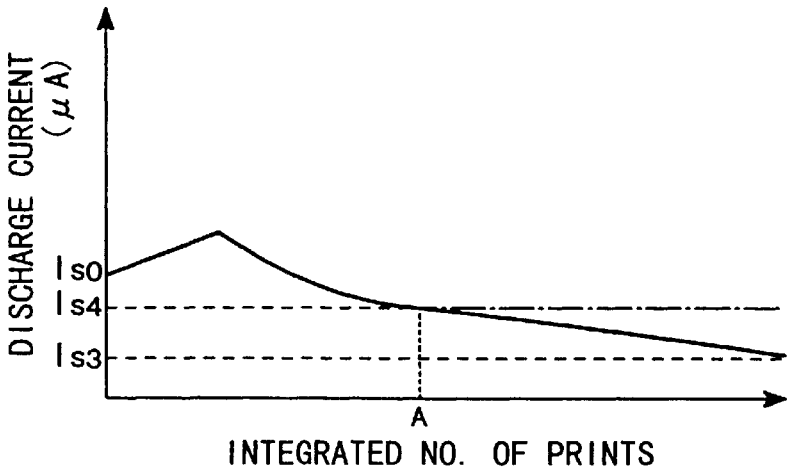
FIG. 10 is a graph for showing the relationship between the cumulative print count and amount of the discharge current.

The peak current Ip detected by the first current detecting means 26 decreases as the cumulative print count (image formation count) increases, as shown by the solid line in FIG. 9, unless the range of the total output current is specified. Thus, the decrease in the peak current Ip can be suppressed by executing such a control that the peak current Ip of the total output current remains within a range of I01–I02 until the cumulative print count reaches a predetermined count A, and then, remains at Io2 after the cumulative print count reaches the predetermined count A. Further, if the peak current Ip exceeds Io1 due to the changes in the charge roller impedance, noises, and the like, before the cumulative print count reaches the predetermined count A, the peak current Ip is kept at Io1 thereafter.

Therefore, if the peak current Ip is fixed after the saturation of the charge roller 2 by toner or the like contaminant, which is the essential cause of the increase in discharge current, the amount of the discharge current assumes a value of Is4, which is greater than the aforementioned Is3, when the cumulative print count is in the adjacencies of the count A in the latter half of the service life of the photosensitive drum.

As described above, in this embodiment, the amount of the discharge current is prevented from drastically increasing or decreasing due to the contamination of the charge roller 2, noises, and the like, by executing such a control that when the amount of the peak current Ip applied to the charge roller 2 is within a predetermined range, the amount of the instantaneous current correspondent to the positive or negative peak of the AC voltage remains at a predetermined level, whereas when the value of the peak current Ip is outside the predetermined range, the peak current Ip remains at the predetermined level. Thus, it is possible to prevent the photosensitive drum 1 from being shaved at an accelerated rate as the cumulative print count increases. Further, the improper charging of the photosensitive drum 2 resulting from excessive decrease in discharge current can be prevented.

In this embodiment, the structural arrangement is such that the peak current it detected by the first current detecting means 26. However, there is no restriction regarding this matter. For example, an effect similar to that in this embodiment can be obtained by detecting the r.m.s. value of the AC current, which correlates to the total output current Io.

EMBODIMENT 2

Also this embodiment will be described with reference to the image forming apparatus (laser printer) in the first embodiment, shown in FIG. 1, and the control system, shown in FIG. 6, for controlling the charge bias applied to the charge roller 2.

In this embodiment, a bottom limit is set for the r.m.s. value of the AC current applied to the charge roller 2, and control is executed in such a manner that the value of the instantaneous current correspondent to the positive or negative peak of the AC voltage remains at a predetermined level when the r.m.s. value of the AC current is above the bottom limit. To the charge roller 2, a combination of an AC voltage having a frequency of 1,000 Hz and a predetermined value, and a DC voltage of −650 V, is applied from the charge bias power source 11 (high voltage transformer driver circuit 20, high voltage transformer 21, and high voltage DC current generation circuit 22). Otherwise, this embodiment is the same in structure as the first embodiment.

Figure 11:
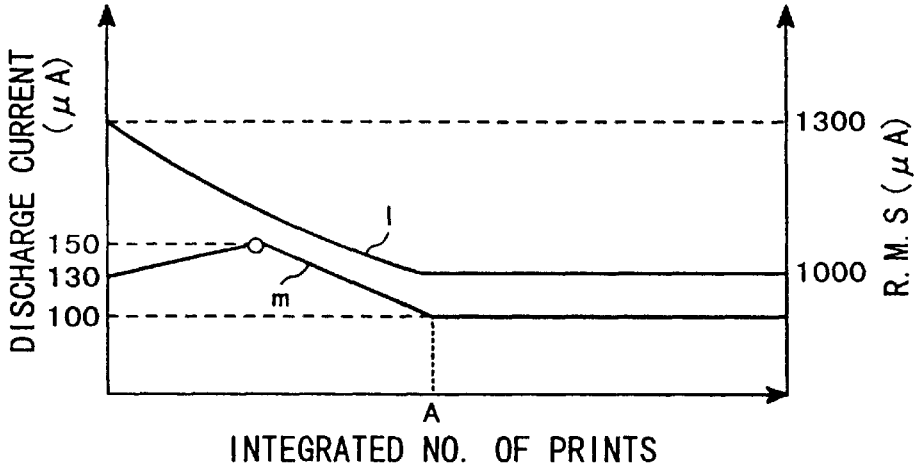
FIG. 11 is a graph for showing the relationship among the cumulative print count, r.m.s. value of the AC current applied to the charge roller, and the amount of the discharge current.

More specifically, referring to FIG. 11, the initial r.m.s. value 1 of the AC voltage is set at 1,300 μA, and control is executed so that until the cumulative print count (image formation count) reaches a predetermined count A, the amount of the instantaneous current correspondent to the negative peak of the AC voltage remains at a predetermined level, whereas after the cumulative print count reaches the predetermined count, the r.m.s. value 1 of the AC current is held at 1,000 μA. In this control, the amount of m of the discharge current climbs from the initial value of 130 μA to a value of 150 μA, and after the cumulative print count (image formation count) reaches the predetermined count A, it is held at 100 μA, With this control, it is possible to suppress the phenomenon that the speed at which the photosensitive layer 1*b* of the photosensitive drum 1 its shaved is accelerates as the cumulative print count (image formation count) increases. Further, it is possible to prevent the improper charging of the photosensitive drum 1 caused by the excessive decrease in the discharge current.

Further, in this embodiment, only a bottom limit is set for the value of the AC current applied to the charge roller 2. However, a top limit may also be set to prevent the phenomenon that the discharge current from the charge roller 2 is excessively increased by noises or the like.

Incidentally, in this embodiment, the structural arrangement is such that the r.m.s. value of the AC current applied to the charge roller 2 is held at the predetermined level. However, the same effect can be obtained by holding the peak value or the AC current applied to the charge roller 2, at a predetermined level.

EMBODIMENT 3

Also this embodiment will be described with reference to the image forming apparatus (laser printer) in the first embodiment, shown in FIG. 1, and the control system, shown in FIG. 6, for controlling the charge bias applied to the charge roller 2.

In this embodiment, control is executed so that the bottom limit of the r.m.s. value of the AC current applied to the charge roller 2 is adjusted according to the length of the charging time of the photosensitive drum 1, and as long as the r.m.s. value of the AC current is above this bottom limit, the amount of the instantaneous current correspondent to the positive or negative peak of the AC current remains at a predetermined level. To the charge roller 2, a combination of an AC voltage having a frequency of 1,350 Hz and a predetermined value, and a DC voltage of −650 V is applied from the charge bias power source 11 (high voltage transformer driver circuit 20, high voltage transfer 21, and high voltage DC current generator circuit 22). Otherwise, this embodiment is the same in structure as the first embodiment.

Figure 12:
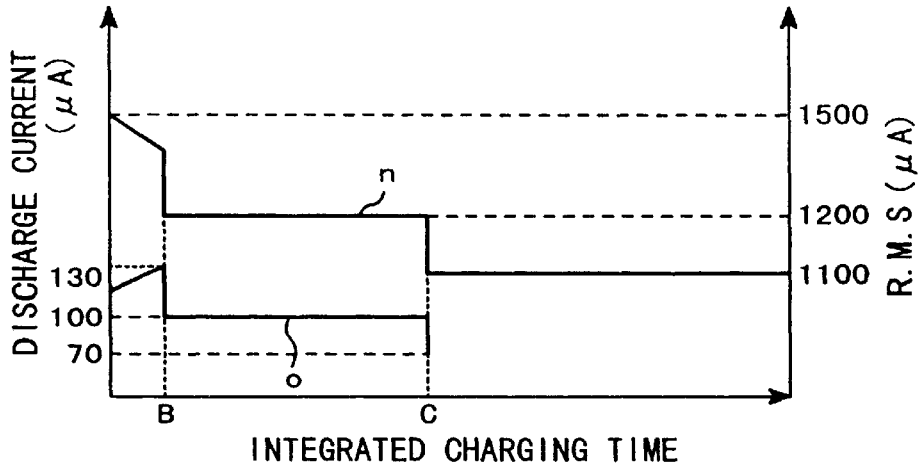
FIG. 12 is a graph showing the relationship among the cumulative length of charging time, r.m.s. value of the AC current applied to the charge roller, and amount of the discharge current.

More specifically, referring to FIG. 12, the r.m.s. value n of the AC current is initially set to 1,500 μA, and control is executed so that the amount of the instantaneous current correspondent to the negative peak of the AC voltage remains at a predetermined value. Two different bottom limits are set for the r.m.s. value of the AC current depending on the cumulative length of charging time. In other words, as the cumulative length of charging time reaches a predetermined value B, the r.m.s. value of the AC current is switched to 1,200 μA, and is held at this level until the cumulative length of charging time reaches a predetermined value C. As the cumulative length of charging time reaches the predetermined value C, the r.m.s. value of the AC current is switch to 1,100 μA, and is held at this level thereafter. During this period, the amount of o of the discharge current rises from the initial 120 μA to 130 μA. Then, as the cumulative length of charging time the predetermined value B, it becomes 100 μA. Then, as the cumulative length of charging time reaches the predetermined value C, it becomes 70 μA, and is held at this level thereafter.

With the use of the above control, it is possible to prevent the speed at which the photosensitive layer 1*b* of the photosensitive drum 1 from being accelerated as the cumulative length of charging time increased. Further, it is possible to prevent the phenomenon that the photosensitive drum 1 is improperly charged due to the excessive decrease in the discharge current.

Although, in this embodiment, only a bottom limit is set for the amount of the AC current applied to the charge roller 2, the addition of a top limit can prevent the discharge current of the charge roller 2 from excessively increasing due to noises and the like.

Further, in this embodiment, two different levels at which the r.m.s. value of the AC current applied to the charge roller 2 is switched are provided. However, three or more levels may be set as the levels at which r.m.s. value of the AC current is switched.

Further, although in this embodiment, control is executed so that the r.m.s. value of the AC current applied to the charge roller 2 remains constant, the same effect can be also obtained by keeping constant the peak value of the AC current applied to the charge roller 2.

EMBODIMENT 4

Also this embodiment is described with reference to the image forming apparatus (laser printer) in the first embodiment shown in FIG. 1, and the control system, shown in FIG. 6, for controlling the charge bias applied to the charge roller 2.

In this embodiment, the bottom limit for the r.m.s. value of the AC current applied to the charge roller 2 is adjusted according to the internal or external environmental factors, that is, temperature and humidity, of the image forming apparatus, and control is executed so that as long as the r.m.s. value of the AC current applied to the charger roller 2 is above the bottom limit, the amount of the instantaneous current correspondent to the positive or negative peak of the AC voltage remains at a predetermined level. To the charge roller 2, a combination of an AC voltage having a frequency of 1,350 Hz and a predetermined value, and a DC voltage of −650 V is applied from the charge bias power source 11 (high voltage transformer driver circuit 20, high voltage transformer 21, and high voltage DC current generator circuit 22). Otherwise, this embodiment is the same in structure as the first embodiment.

Figure 13:
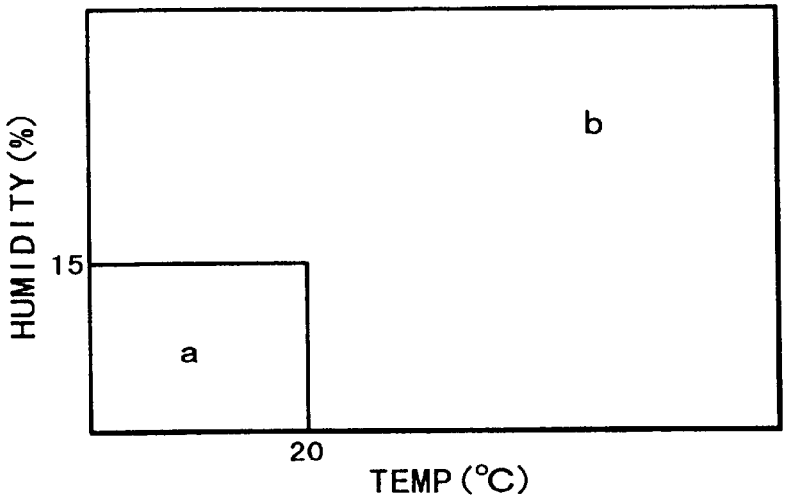
FIG. 13 is a graph for showing the temperature level and humidity level.

More specifically, referring to FIG. 13, two environmental conditions a and b are set. In the environmental condition a, temperature Is no more than 20° C. and humidity is no more than 15%, whereas in the environmental condition b, temperature is no less than 20° C. and humidity is no less than 15%.

Figure 14:
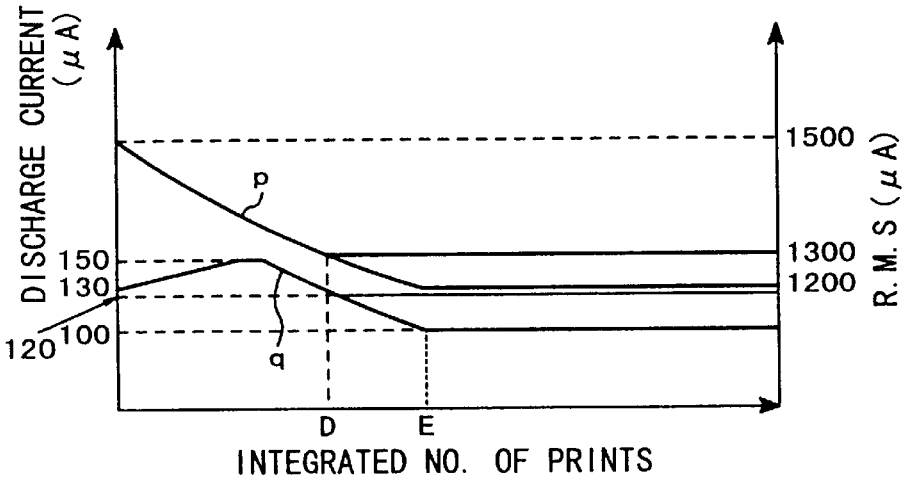
FIG. 14 is a graph for showing the relationship among the cumulative length of charging time, r.m.s. value of the AC current applied to the charge roller, and amount of the discharge current.

Next, referring to FIG. 14, the r.m.s. value n of the Ac current is initially set to 1,500 μA, and control is executed so that the amount of the instantaneous current correspondent to the negative peak of the AC voltage remains at a predetermined level. Further, two different bottom limits are set for the r.m.s. value of the AC current according to the cumulative length of charging time. In other words, when the environmental condition is a (temperature is no higher than 20° C. and humidity is no less than 15%), after the cumulative print count (image formation count) reaches a predetermined count E, the r.m.s. value p of the AC current is held at 1,200 μA.

When control is executed as described above, initially, the amount q of the discharge current rises from 130 μA to 150 μA. Then, when the environmental condition is a, it is held at 120 μA from the point when the cumulative print count (image formation count) reaches the predetermined count D, whereas when the environmental condition is b, it is held at 100 μA from the point when the cumulative print count (image formation count) reaches the predetermined count E. This is due to the fact that the amount of the discharge current which causes the improper charging of the photosensitive drum 1 varies depending on the amount of the contamination of the charge roller 2 which varies depending on the ambient temperature and humidity, and therefore, the bottom limit for the r.m.s. value of the AC current must be set be greater for the ambience a than for the ambience b.

With the execution of the above described control, it is possible to suppress the phenomenon that the speed at which the photosensitive layer 1*b*, or the surface layer, of the photosensitive drum 1 accelerates as the cumulative print count (image formation count) increases. Further, it is possible to prevent the phenomenon that the photosensitive drum 1 is improperly charged due to the excessive decrease in the discharge current. Although in this embodiment only the bottom limits are set for the amount of the AC current applied to the charge roller 2 top limits may be added to prevent the phenomenon that the discharge current of the charge roller 2 is excessively increased by noises and the like.

In this embodiment, two different levels are set for both ambient temperature and humidity. However, three or more levels may be set. Further, in this embodiment, control is executed to keep constant the r.m.s. value of the AC current applied to the charge roller 2. However, the same effect can be obtained by keeping constant the peak value of the AC current applied to the charge roller 2.

EMBODIMENT 5

Also this embodiment will be described with reference to the image forming apparatus (laser printer) in the first embodiment shown in FIG. 1, and the control system, shown in FIG. 6, for controlling the charge bias applied to the charge roller 2.

Figure 15:
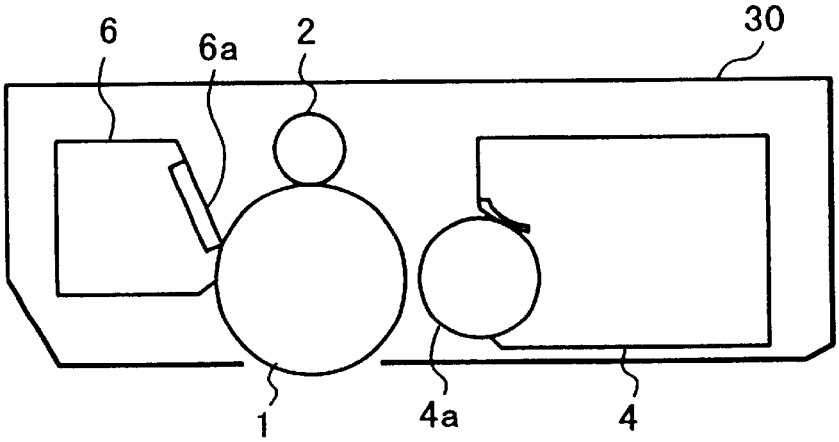
FIG. 15 is a rough sectional view of a process cartridge.
Figure 19:
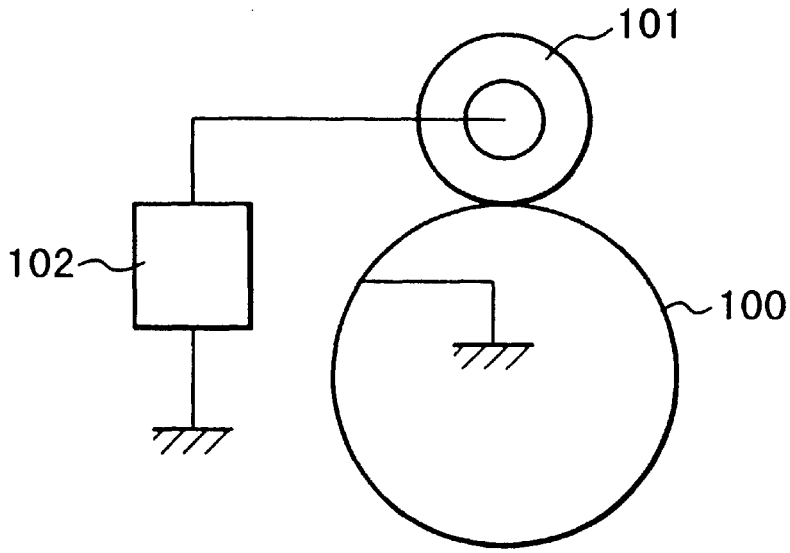
FIG. 19 is a drawing for describing the contact type charging method.
Figure 20:
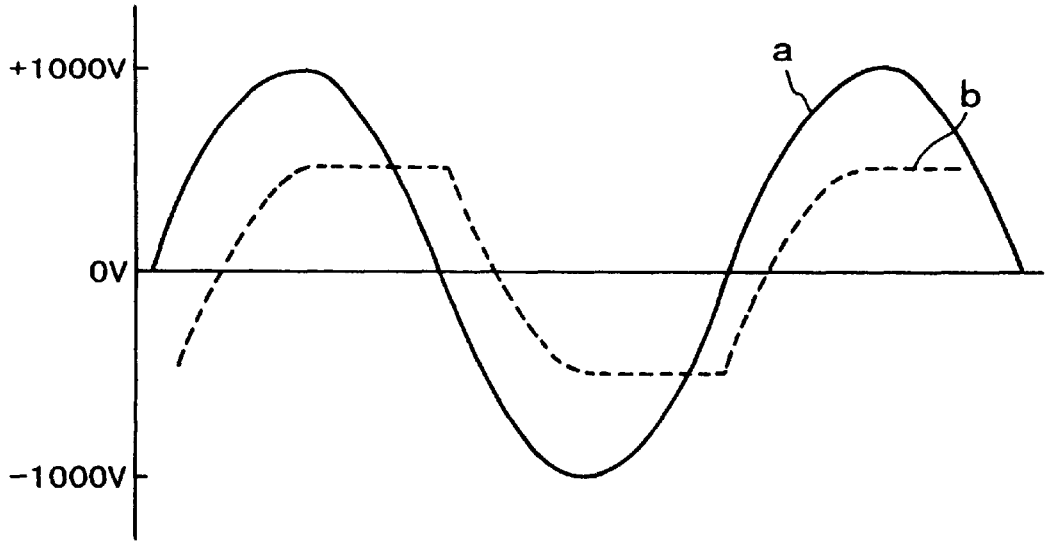
FIG. 20 is a graph for showing the relationship in terms of wave-form between the voltage applied to a photosensitive drum to charge the photosensitive drum by a contact type AC based charging method, and the surface potential level of the photosensitive drum.

Referring to FIG. 15, in this embodiment, the photosensitive drum 1, charge roller 2, developing apparatus 4, and cleaning apparatus 6 are integrated in the form of a process cartridge 30, which is removably mountable in the main assembly of an image forming apparatus. Next, referring to FIG. 16, the process cartridge 30 is provided with a writable nonvolatile storage medium 31, which is connected to the controlling apparatus (unshown) within the image forming apparatus through a connector 32. To the nonvolatile storage medium 31, the cumulative length of time during which the photosensitive drum 1 is charged by the charge roller 2 is written.

In this embodiment, the range for the amount of the first AC current detected by the first current detecting means 26 is varied based on the information, that is, the cumulative length of charging time, written in the nonvolatile storage medium 31. More specifically, to the nonvolatile storage medium 31, the cumulative length of time during which the photosensitive drum 1 is charged by the charge roller 2 is written, and this information is compared to a predetermined length of time, after the elapse of which, the bottom limit of the r.m.s. value of the AC current is switched, and which is stored in the memory (unshown) provided on the image forming apparatus side. As the cumulative length of charging time reaches the above described predetermined length of time stored in the memory on the image forming apparatus side, the bottom limit for the amount of r.m.s. value of the AC current is changed. For example, while the cumulative length of charging time is within a range of 0–30,000 seconds, the bottom limit is kept at 1,300 μA, and as the cumulative length of charging time reaches 30,000 seconds, the bottom limit is changed to 1,200 μA, as shown in FIG. 17.

Referring to FIG. 18, in this embodiment, initially, the r.m.s. value r of the AC current and the amount s of the discharge current are set to 1,500 μA and 130 μA, respectively, and control is executed so that the amount of the instantaneous current correspondent to the negative peak of the AC voltage remains at a predetermined level. After the cumulative length of charging time reaches 20,000 seconds, the r.m.s. value r of the AC current is held at 1,300 μA. At the moment when the cumulative length of charging time reaches the 20,000 seconds, the amount s of the discharge current becomes 120 μA. Thereafter, until the cumulative length of charging time reaches 30,000 seconds, the r.m.s. value of the AC current is held at 1,300 μA, and as the cumulative length of charging time exceeded 30,000 seconds, the bottom limit for the r.m.s. value of the AC current is changed. Based on this change, control is executed so that the amount of the instantaneous current remains at the predetermined level. Therefore, as the cumulative length of charging reaches 45,000 seconds, the r.m.s. value of the AC current reaches 45,000 seconds, the r.m.s. value of the AC current becomes 1,100 μA, or the bottom limit, and is held at this level thereafter. During this period, the amount s of the discharge current is 70 μA. The above described control is executed due to that fact the amount of the discharge current with which the improper charging of the photosensitive drum 1 occurs is affected by the difference in the contamination of the charge roller 2 by toner and the like, and therefore, while the cumulative length of charging time is short, the bottom limit for the r.m.s. value of the AC current must be set higher.

With the execution of the above described control, it is possible to prevent the phenomenon that the speed at which the photosensitive drum 1 is shaved is accelerated by the arrangement made for preventing the increase in the discharge current. Further, it is possible to prevent the phenomenon that the photosensitive drum 1 is improperly charged due to the excessive decrease in the discharge current.

Although in this embodiment, the r.m.s. value of the AC current is held, the present invention is not limited to this arrangement. For example, the same effect can be obtained even if the average value of the AC current within a predetermined range, peak value of the AC current, or integral value of the AC current, or the like is held. As for the reference for switching the bottom limit for the r.m.s. value of the AC current, the cumulative length of charging time is employed. However, the selection of the reference is not limited to the cumulative length of charging time. For example, the reference may be the number of the photosensitive drum 1 rotations, pixel count, output value of a toner remainder detecting means (unshown), output value of ambience detecting means (unshown), or combinations among them. The combinations among the aforementioned references for switching the bottom limit for the r.m.s. value f the AC current are particularly preferable because such combinations make it possible to detect with higher accuracy the timing with which the bottom limit should be switched. Further, two different levels at which the switching is made are provided. However, the number of the levels at which the switching is made does not need to be limited to two. Further, only the bottom limit is set for the amount of the AC current. However, the addition of a top limit may be preferable, since such an addition makes it possible for the discharge current of the charge roller 2 to be prevented from being excessively increased by noises and the like.

While the invention has been described with reference to the structures disclosed herein, it is not confined to the details set forth, and this application is intended to cover such modifications or changes as may come within the purposes of the improvements or the scope of the following claims.

What is claimed is:

1. An image forming apparatus comprising:

an image bearing member;

a charge member contacted to said image bearing member to electrically charge said image bearing member;

voltage applying means for applying to said charge member an oscillating voltage including an AC voltage component;

first detecting means for detecting an AC current applied to said charge member from said voltage applying means;

second detecting means for detecting the AC current corresponding to a peak or a neighborhood of the peak of the AC voltage;

control means for effecting control such that current detected by said second detecting means is a predetermined level when the current detected by said first detecting means is within a predetermined range and such that current detected by said first detecting means is a predetermined level when the current detected by said first detecting means is outside said predetermined range.

2. An apparatus according to claim 1, wherein the detected current by said first detecting means is an effective value of the AC current.

3. An apparatus according to claim 1, wherein the detected current by said first detecting means is a peak value of the AC current.

4. An apparatus according to claim 1, wherein the detected current by said first detecting means is an average value of the AC current.

5. An apparatus according to claim 1, wherein the detected current by said first detecting means is an integrated value of the AC current.

6. An apparatus according to claim 1, wherein the AC current applied to said charge member from said voltage applying means is kept at a lower limit of the predetermined range, when the AC current reaches the lower limit.

7. An apparatus according to claim 6, wherein the lower limit is variable in accordance with information relating to an operational condition.

8. An apparatus according to claim 7, wherein the information is an integrated value of charging time of said change member.

9. An apparatus according to claim 6, wherein the lower limit is variable in accordance with an ambient condition.

10. An apparatus according to claim 9, wherein the ambient condition is at least one of a temperature and a humidity.

11. An apparatus according to claim 6, further comprising non-volatile memory medium in which an integrated value of the charging time of the charge member can be written in, wherein the lower limited of the predetermined range is changed in accordance with the information written in said non-volatile memory medium.

12. An apparatus according to claim 1, wherein at least said image bearing member and said charge member is contained in a process cartridge which is detachably mountable to a main assembly of said apparatus as a unit.

* * * * *

UNITED STATES PATENT AND TRADEMARK OFFICE

CERTIFICATE OF CORRECTION

PATENT NO. : 6,539,184 B2
DATED : March 25, 2003
INVENTOR(S) : Masaru Shimura et al.

It is certified that error appears in the above-identified patent and that said Letters Patent is hereby corrected as shown below:

Column 8,
Line 7, “an” should read -- on --.

Column 10,
Line 10, “FIG. 8,” should read -- FIG. 3, --.

Column 11,
Line 40, “its” should read -- is --; and “is” should be deleted.

Column 12,
Line 24, “switch” should read -- switched --.

Column 13,
Line 16, “Ac” should read -- AC --; and
Line 42, “be” should be deleted.

Column 16,
Line 3, “voltage;” should read -- voltage; and --;
Line 33, “change” should read -- charge --;
Line 41, “non-volatile” should read -- a non-volatile --; and
Line 43, “limited” should read -- limit --.

Signed and Sealed this

Thirteenth Day of January, 2004

JON W. DUDAS
*Acting Director of the United States Patent and Trademark Office*